US007281993B2

(12) United States Patent
Oyama

(10) Patent No.: US 7,281,993 B2
(45) Date of Patent: Oct. 16, 2007

(54) GOLF CLUB HEAD AND MANUFACTURING METHOD OF THE SAME

(75) Inventor: Hitoshi Oyama, Kobe (JP)

(73) Assignee: SRI Sports Limited, Kobe (JP)

( * ) Notice: Subject to any disclaimer, the term of this patent is extended or adjusted under 35 U.S.C. 154(b) by 296 days.

(21) Appl. No.: 11/050,714

(22) Filed: Feb. 7, 2005

(65) Prior Publication Data

US 2005/0209024 A1 Sep. 22, 2005

(30) Foreign Application Priority Data

Mar. 17, 2004 (JP) ..... 2004-076760

(51) Int. Cl.
*A63B 53/04* (2006.01)
*B29D 22/00* (2006.01)
*B29C 45/14* (2006.01)

(52) U.S. Cl. ..... 473/345; 473/347; 473/349; 264/516; 264/572; 264/574

(58) Field of Classification Search ..... 473/324–350, 473/290–292, 409; 264/516, 572, 574
See application file for complete search history.

(56) References Cited

U.S. PATENT DOCUMENTS 4,204,684 A * 5/1980 Molitor ..... 473/349
4,451,041 A * 5/1984 Hayashi et al. ..... 473/348
4,479,652 A * 10/1984 Nagamoto ..... 473/347
4,575,447 A * 3/1986 Hariguchi ..... 264/516
4,581,190 A * 4/1986 Nagamoto et al. ..... 264/136
4,624,460 A * 11/1986 Murase et al. ..... 473/309
4,630,826 A * 12/1986 Nishigaki et al. ..... 473/329
4,778,185 A * 10/1988 Kurokawa ..... 473/332
4,883,623 A * 11/1989 Nagamoto et al. ..... 264/108
5,277,866 A * 1/1994 Wright ..... 264/572
5,350,556 A * 9/1994 Abe et al. ..... 264/248
6,159,415 A * 12/2000 Tanada ..... 264/513
6,354,963 B1 * 3/2002 Kodama et al. ..... 473/345
6,386,990 B1 5/2002 Reyes et al.
6,406,378 B1 6/2002 Murphy et al.
6,849,003 B2 * 2/2005 Kumamoto ..... 473/305
6,929,565 B2 * 8/2005 Nakahara et al. ..... 473/345
6,955,612 B2 * 10/2005 Lu ..... 473/324
7,128,662 B2 * 10/2006 Kumamoto ..... 473/345
2005/0096154 A1 * 5/2005 Chen ..... 473/345

* cited by examiner

*Primary Examiner*—Sebastiano Passaniti
(74) *Attorney, Agent, or Firm*—Birch, Stewart, Kolasch & Birch, LLP

(57) ABSTRACT

The invention prevents a crimple from being generated in a resin member. The invention provides a golf club head (1) including a head shell portion (M) made of a metal material and having an opening portion (O1), and a resin member (FR) made of a fiber reinforced resin arranged in the opening portion (O1), and provided with a hollow portion in an inner portion. The resin member (FR) is constituted by a molded body formed by integrally molding a laminated body of plural layers of prepregs having a magnitude covering the opening portion (O1) and having different resin percentage contents in the head shell portion in accordance with an internal pressure molding method. Further, the prepreg having the largest resin percentage content is used in an innermost layer of the laminated body closest to the hollow portion.

7 Claims, 12 Drawing Sheets

GOLF CLUB HEAD AND MANUFACTURING METHOD OF THE SAME

BACKGROUND OF THE INVENTION

1. Field of the Invention

The present invention relates to a golf club head structured by using a metal material and a fiber reinforced resin, and a manufacturing method of the same.

2. Prior Art

There have been proposed various golf club heads in which a fiber reinforced resin member is combined in a part of a metal material member which is main part of the golf club head (hereinafter, this may be sometimes called simply as "combined head"). A weight of the combined head can be reduced by using the parts made of a fiber reinforced resin having a small specific gravity, and there is an advantage that a freedom of designing a weight distribution of the head can be improved by allocating the reduced weight to a side portion of the head, for example, a toe or a heel, or allocating to a back face.

Further, the combined head can be manufactured by adhering a resin member made of a fiber reinforced resin and previously molded in a predetermined shape, for example, to an opening portion of a head shell portion made of a metal material, (hereinafter, this manufacturing method may be sometimes called simply as "adhesive bonding method"). However, in accordance with the adhesive bonding method, a gap or a step tends to be formed on the boundary of a junction between the head shell portion and the resin member, and an outer appearance and a showing of the head tend to be deteriorated. Further, there is a risk that a fitting of both the members does not stabilize due to a dispersion in manufacturing the head shell portion and/or the resin member, and there is a risk that an adhesive strength is lowered, by extension. If the adhesive strength is lowered, the resin member tends to come off from the head shell portion due to an impact force at a time of hitting a ball.

As the other method of manufacturing the combined head, there has been known a so-called internal pressure molding method (refer, for example, to Japanese Unexamined Patent Publication No. 2001-190716 and Japanese Unexamined Patent Publication No. 2001-190718). The internal pressure molding method heats a head base body formed by arranging a laminated body P comprising a plurality of prepregs under a partially cured state in an opening portion O1 of a head shell portion M made of a metal material, as shown in FIG. 7A, in a metal mold 20 as shown in FIG. 7B, and inflates a bladder B in a hollow portion i. Accordingly, the laminated body P is exposed to a heat energy and a pressure, is strongly pressed against a cavity side of the metal mold 20 so as to be formed in a predetermined shape, and is firmly fixed to a periphery of the opening portion O1 of the head shell portion M. In accordance with the internal pressure molding method mentioned above, it is possible to reduce the gap or the step on the boundary between the head shell portion M and the resin member FR as much as possible as is different from the adhesive bonding method, and it is possible to provide a head having an improved appearance.

However, the internal pressure molding method has the following disadvantage. In other words, in accordance with the internal pressure molding method, in order to make the laminated body P of the prepreg closely contact with the surfaci of the cavity C of the metal mold 20, it is necessary to expand to an outer side comparatively largely. For this purpose, it is necessary to uniformly apply a pressure to the laminated body P of the prepreg from an inner side. However, there is a case that a temporal shift is generated in each of portions in the contact between the bladder B and the laminated body P at a time of inflating the bladder B, whereby an uneven internal pressure is applied to the laminated body P. As a result, the laminated body P can not uniformly inflate to the outer side, and a defect in molding such as a crimple and a concavity and convexity is generated on a surface of the molded resin member. Further, since not only the crimple and the concavity and convexity generate a problem in the outer appearance, but also the reinforced fiber in this part is folded, it is impossible to obtain a sufficient strength and the crimple and the concavity and convexity tend to generate a starting point of a damage.

SUMMARY OF THE INVENTION

The present invention is made by taking the actual condition mentioned above into consideration, and a main object of the present invention is to provide a golf club head which is possible to improve a flow property of the prepreg which is in contact with a bladder, and it is possible to inhibit a defect in molding from being generated by uniformly applying a pressure to the laminated body by extension.

In accordance with the invention on the basis of the first or sixth aspect, the laminated body of the prepreg constituting the resin member of the combined head is structured by a plurality of prepregs having the different resin percentage contents, and the prepreg having the largest resin percentage content is used in the innermost layer closest to the hollow portion. The prepreg having the larger resin percentage content has an improved flow property in a plasticized state in comparison with the prepreg having the smaller resin percentage content, and can obtain a great flow property (slip and deformation) on a surface at a time of being in contact with the bladder by extension. In other words, the surface can flexibly follow a shape of the bladder, and it is possible to uniformly transmit the pressure to the outside prepreg. Accordingly, it is possible to apply a uniform pressure to each of the portions of the laminated body, and it is possible to inhibit the defect in molding such as the crimple from being generated in the resin member.

Further, in accordance with the invention on the basis of the fifth aspect, the laminated body of the prepreg constituting the resin member of the combined head is structured by a plurality of prepregs having the different resin percentage contents, at least one layer of the prepreg having the smallest resin percentage content is used in an intermediate layer arranged between the innermost layer and the outermost layer, and the prepreg having the larger resin percentage content than that of the prepreg having the smallest resin percentage content is used in the innermost layer and the outermost layer. As a result, it is possible to improve the flow property at a time of being in contact with the cavity even in the outermost layer of the laminated body which is in contact with the cavity of the metal mold. Accordingly, in accordance with the invention, the innermost layer of the laminated body can flexibly follow the shape of the bladder, and the outermost layer can flexibly follow the shape of the cavity, whereby it is possible to further inhibit the defect in molding such as the crimple or the like from being generated in the resin member.

Further preferred embodiments of the invention are set forth in the suboreinte claims, in the description and also in the drawing.

DESCRIPTION OF THE PREFERRED EMBODIMENTS

A description will be given below of an embodiment in accordance with the present invention with reference to the accompanying drawings.

Figure 1:
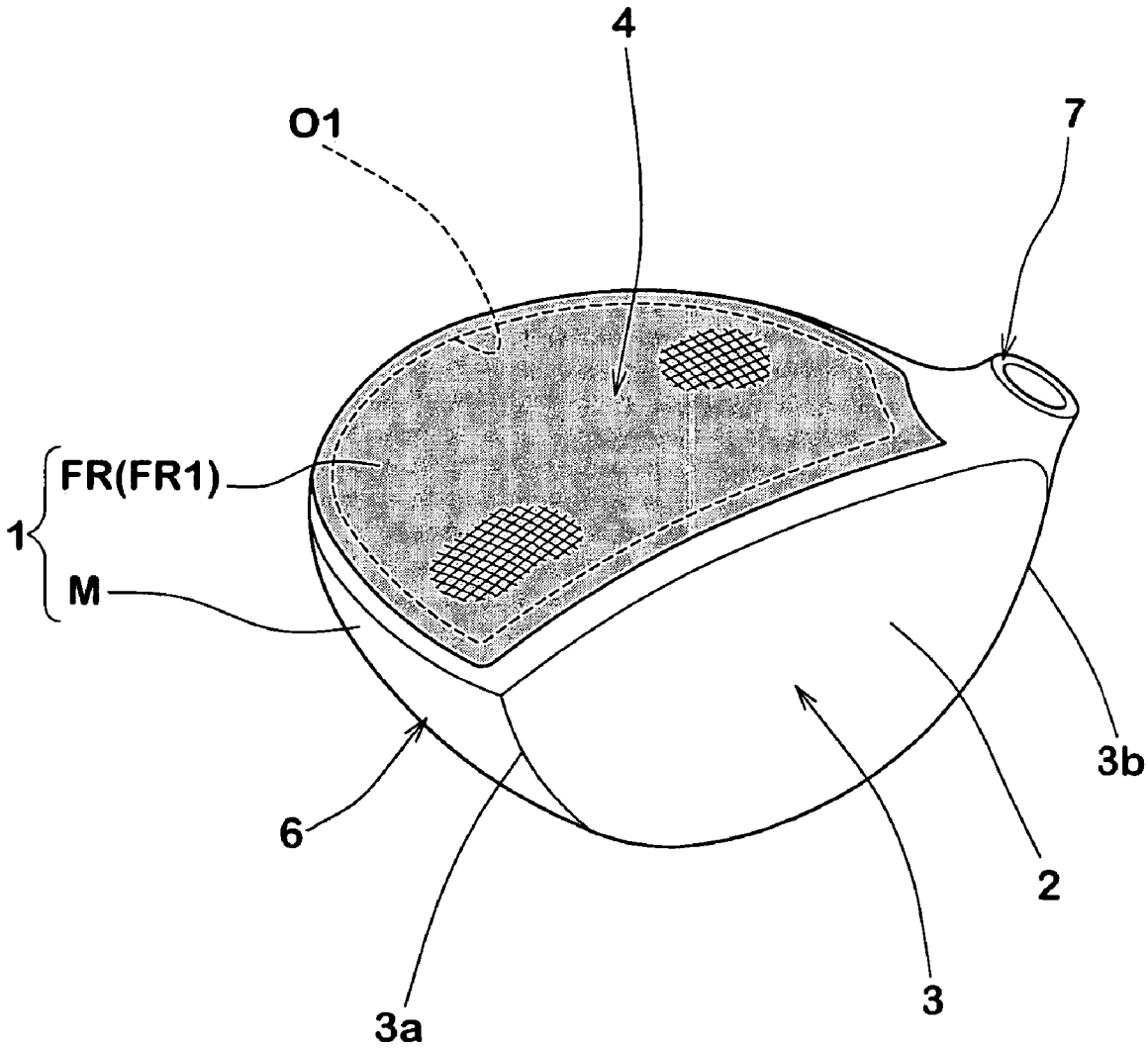
FIG. 1 is a perspective view of a standard condition of a head showing an embodiment in accordance with the present invention.
Figure 2:
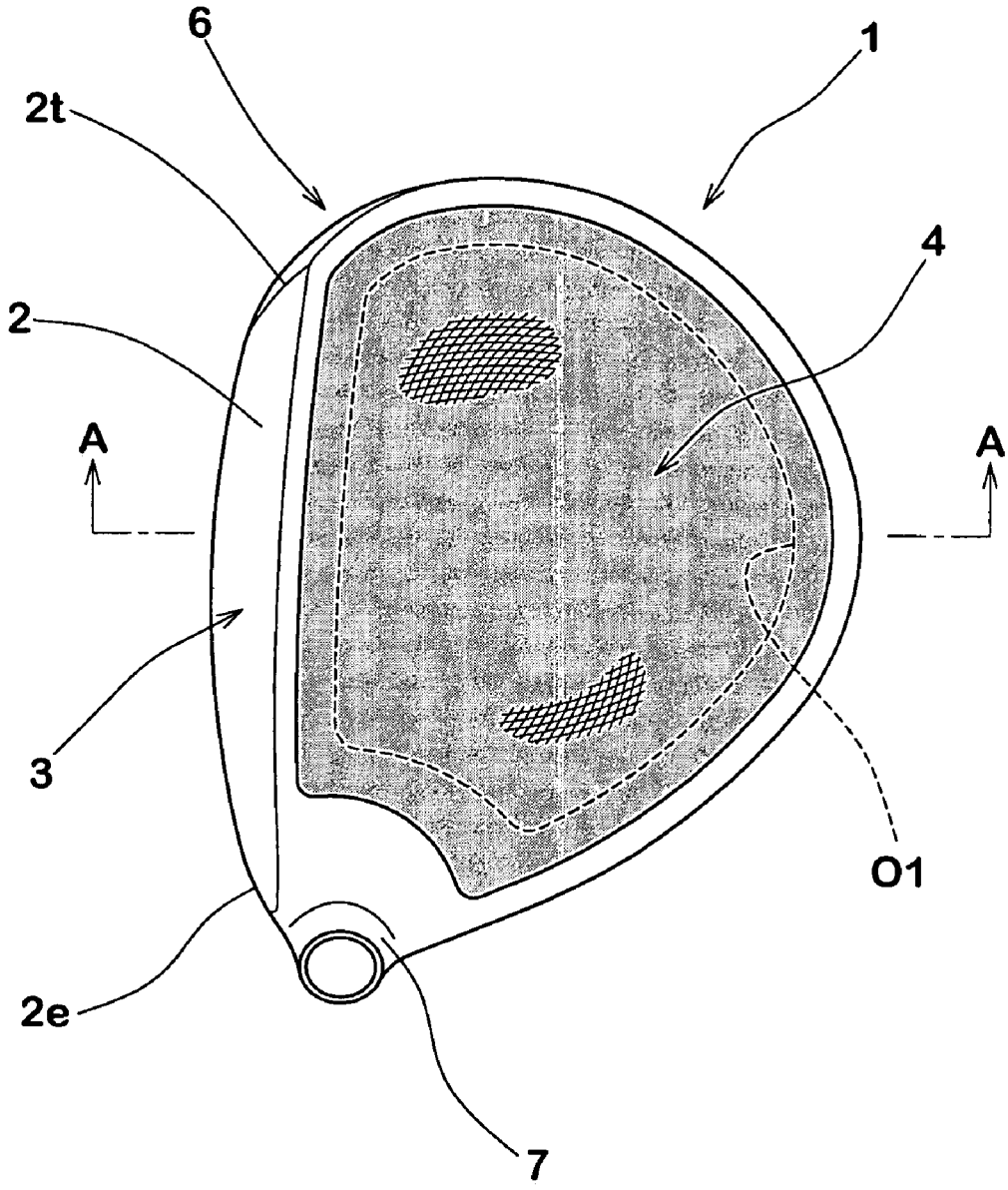
FIG. 2 is a plan view thereof.
Figure 3:
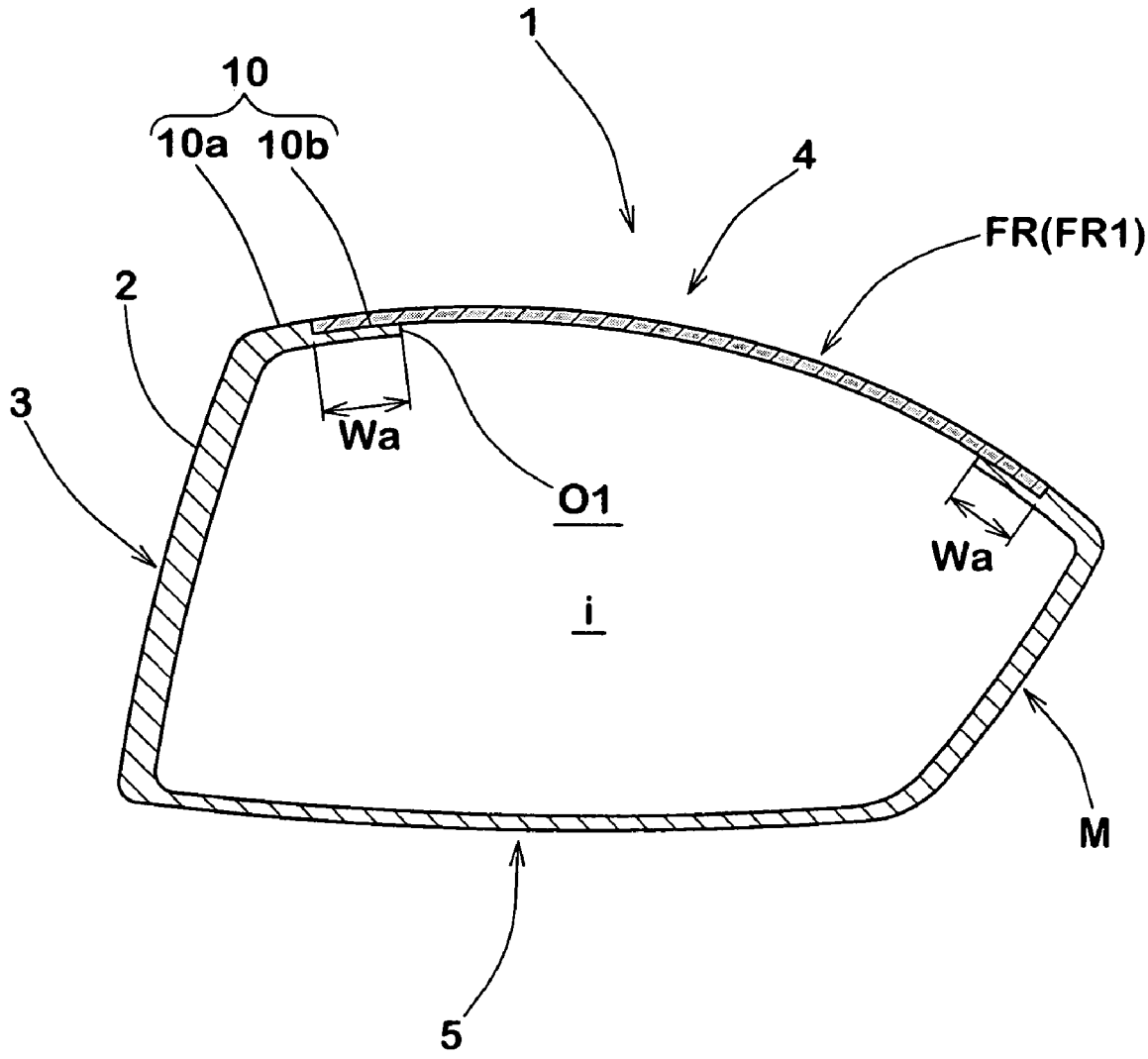
FIG. 3 is a cross sectional view along a line A-A in FIG. 2.
Figure 4:
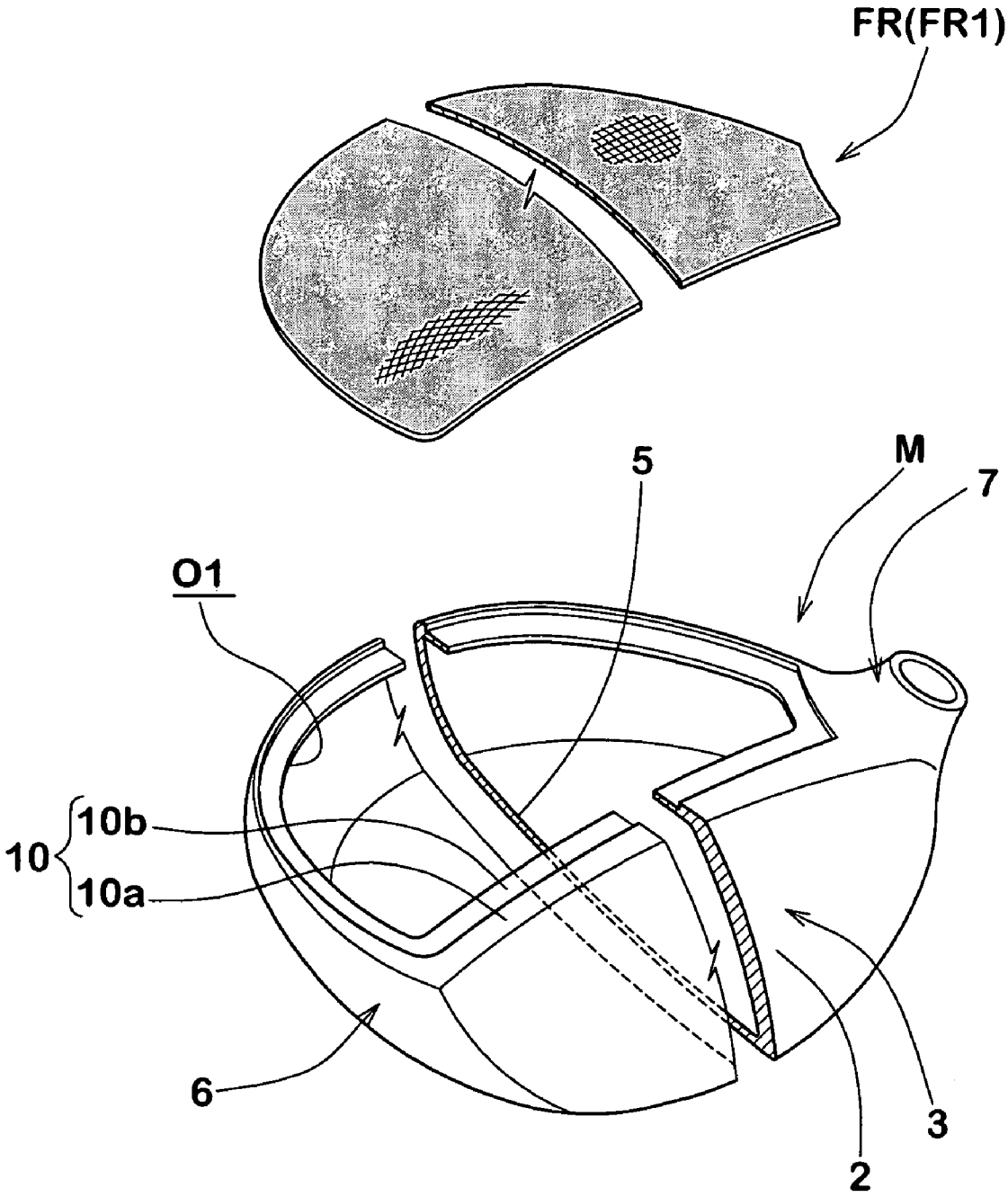
FIG. 4 is an exploded perspective view of the head.

FIG. 1 is a perspective view of a standard condition in which a golf club head (hereinafter, this may be sometimes called simply as "head") in accordance with the present embodiment is grounded on a horizontal surface at prescribed lie angle and loft angle, FIG. 2 is a plan view thereof, FIG. 3 is an enlarged cross sectional view along a line A-A in FIG. 2, and FIG. 4 is an exploded perspective view of the head, respectively.

A head 1 in accordance with the present embodiment is provided with a face portion 3 having a face surface 2 corresponding to a surface hitting a ball, a crown portion 4 connected to the face portion 3 and forming a head upper surface, a sole portion 5 connected to the face portion 3 and forming a head bottom surface, a side portion 6 joining between the crown portion 4 and the sole portion 5 and extending to a heel 3*b* from a toe 3*a* of the face portion 3 through a back face, and a neck portion 7 provided in a heel side of the crown portion 4 and to which one end of a shaft (not shown) is attached, and is exemplified by a wood type head such as a driver (#1) or a fairway wood having a hollow structure provided with a hollow portion i in an inner portion.

Further, the head 1 is formed by using a head shell portion M made of a metal material, and a resin member FR made of a fiber reinforced resin.

The resin member FR in accordance with the present embodiment is exemplified by a structure constituted by a crown side resin member FR1 forming at least a part of the crown portion 4. The resin member FR is made of a combined material obtained by combining a matrix resin and a reinforcing material thereof, in which a specific gravity is smaller than the metal material. Accordingly, the head 1 in accordance with the present invention can obtain a comparatively great weight saving effect by using the resin member FR. The saved weight is, for example, consumed for enlarging a size of the head shell portion M, or allocated to a suitable portion, whereby it is possible to adjust a position of a gravity point and a moment of inertia, thereby serving for improving a freedom of designing a weight distribution.

The matrix resin is not particularly limited, however, it is desirable to employ a thermosetting resin, for example, an epoxy resin, a phenol resin and the like, and a thermoplastic resin such as a nylon resin, a polycarbonate resin and the like. The matrix resin is preferable in the respect that the matrix resin is inexpensive, has an improved adhesive property with the fiber, and has a comparatively short molding time. Further, the fiber is not particularly limited, however, it is possible to employ an organic fiber, for example, a carbon fiber, a glass fiber, an aramid fiber and a polyphenylene benzoxazole resin fiber (PBO fiber), or a metal fiber such as an amorphous fiber, a titanium fiber and the like, and especially, the carbon fiber having a small specific gravity and a large tensile strength is preferable.

Further, an elastic modulus of the fiber is not particularly limited, however, if it is too small, it is impossible to secure a rigidity of the resin member FR and a durability tends to be lowered, and if it is inversely too large, the cost thereof is increased, and a tensile strength tends to be lowered. From this point of view, it is desired that the elastic modulus of the fiber is equal to or more than 50 GPa, more preferably equal to or more than 100 GPa, further preferably equal to or more than 150 GPa, and particularly preferable equal to or more than 200 GPa. Further, it is desirable that an upper limit is preferably equal to or less than 550 GPa, more preferably equal to or less than 450 GPa, and further preferably equal to or less than 350 GPa. In this case, the elastic modulus of the fiber corresponds to an elastic modulus in tension, and is constituted by a value measured in accordance with "carbon fiber test method" in JIS R7601. Further, in the case that two or more kinds of fibers are contained, there is employed an average elastic modulus obtained by calculating the elastic modulus of each of the fibers by weighing on the basis of a weight ratio, as shown by the following expression (1).

$$\text{Average elastic modulus}=\Sigma(Ei\cdot Vi)/\Sigma Vi(i=1, 2, )$$

(wherein Ei is an elastic modulus of a fiber i, and Vi is a total weight of the fiber i)

The head shell portion M in accordance with the present embodiment is structured, as shown in FIG. 4, such as to include the face portion 3, the sole portion 5, the side portion 6, the neck portion 7 and a crown edge portion 10 which is provided with an opening portion 01 to which a crown side resin member FR1 is connected and continuously provided in the face portion 3. The head shell portion M may be integrally formed in each of the portions, for example, in accordance with casting or the like, originally, or may be structured by forming two or more parts in accordance with a working method such as forging, casting, pressing, rolling or the like and thereafter integrally bonding them in accordance with welding or the like.

The metal material forming the head shell portion M is not particularly limited, however, can employ, for example, a stainless steel, a maraging steel, a titanium, a titanium alloy, an aluminum alloy, a magnesium alloy, an amorphous alloy or the like. Especially, a titanium alloy, an aluminum alloy or a magnesium alloy having a large specific strength is desirable. In this case, the head shell portion M can be formed by using two or more kinds of metal materials.

As shown in FIGS. 3 and 4, in accordance with the present embodiment, the crown edge portion 10 of the head shell portion M includes a crown surface portion 10*a* forming an outer surface portion of the crown portion 4 and annularly and a receiving portion 10*b* having a step from the crown surface portion 10*a* in a surface and depressed to a side of the hollow portion i, extending around the opening portion O1 in the present example. The receiving portion 10*b* can hold an inner surface side of the crown side resin member FR1 at a peripheral edge portion thereof. Further, the receiving portion 10*b* absorbs a thickness of the crown side resin member FR1 on the basis of the step mentioned above, and serves for finishing the crown surface portion 10*a* and the resin member FR1 flush.

The receiving portion 10*b* of the head shell portion M and the crown side resin member FR1 are bonded therebetween. The receiving portion 10*b* in accordance with the present embodiment is continuously and annularly provided in the entire periphery around the opening portion O1. As a result, it is possible to bond and hold the entire periphery of the peripheral edge portion of the crown side resin member FR1. This serves for obtaining an adhesive strength. A width Wa of the receiving portion 10*b* (measured in a perpendicular direction from an edge of the opening portion O1) is not particularly limited, however, if it is too small, the bonding area between the head shell portion M and the crown side resin member FR1 becomes small, whereby a bonding strength tends to be lowered, and if it is inversely too large, the area of the opening portion O1 becomes small, whereby there is a tendency that the weight saving effect can not be sufficiently obtained. From this point of view, it is desirable that the width Wa of the receiving portion 10*b* is, for example, equal to or more than 5 mm, and more preferably equal to or more than 10 mm, and it is desirable that the upper limit is equal to or less than 30 mm, and more preferably equal to or less than 20 mm. The width Wa may be constant, or may be varyed.

Further, the crown side resin member FR1 does not necessarily form the entire portion of the crown portion 4, but may form at least a part thereof, however, if the area thereof is too small, there is a tendency that a sufficient weight saving effect can not be obtained. From this point of view, in a plan view in the standard condition shown in FIG. 2, it is desirable that a ratio (S1/S) between an area S1 of the opening portion O1 provided in the crown portion 4 and an area S surrounded by a head profile line is preferably equal to or more than 0.5, and more preferably equal to or more than 0.6, and it is desirable that an upper limit thereof is, for example, equal to or less than 0.9, and preferably equal to or less than 0.8. In this case, the opening portion O1 of this example is shown as the structure included in the crown portion 4, however, is not limited to the aspects mentioned above, but may be formed such that a part of the opening portion extends to the other portion (for example, the side portion 6).

Further, the crown side resin member FR1 is constituted by a molded product integrally formed in the head shell portion M in accordance with an internal pressure molding method. The internal pressure molding method is structured as mentioned already, however, particularly include the following steps in the present embodiment.

Figure 5:
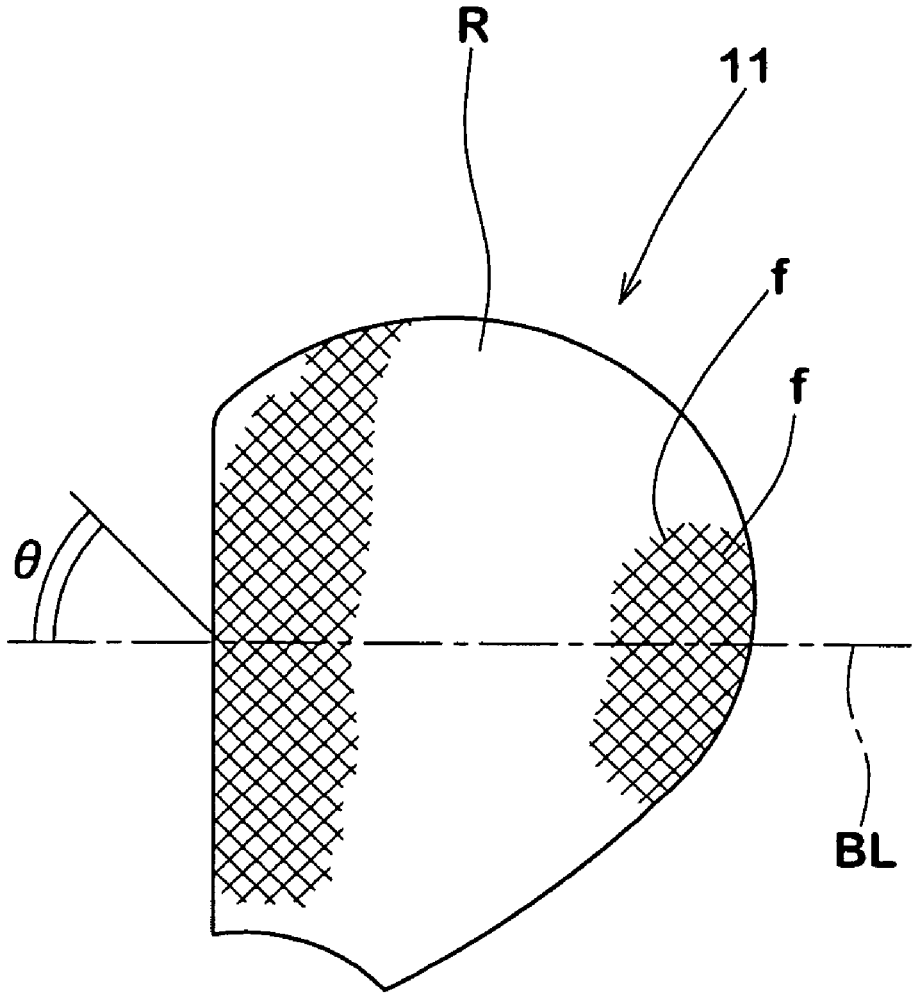
FIG. 5 is a plan view showing an example of a prepreg.

First, a plurality of prepregs having a magnitude capable of covering the opening portion O1 of the head shell portion M are prepared. In FIG. 5, one example of one prepreg 11 for forming the resin member FR is shown by a plan view. The prepreg 11 is a sheet body in a semi hard state in which a resin R is impregnated with a fabric of a carbon fiber aligned in one direction or a woven fabric of a carbon fiber f woven in an intersecting direction (the latter structure is shown in this example), and is used in a state of being appropriately cut in a necessary shape previously as shown in FIG. 5. A profile shape of the prepreg 11 is not particularly limited, however, is generally determined appropriately in correspondence to the opening portion O1 of the head shell portion M. The profile shape of the prepreg 11 in accordance with this example is exemplified by a structure which is larger than the shape of the opening portion O1 and equal to or slightly larger than the outer profile of the receiving portion 10*b*.

Further, a plurality of prepregs 11 having different resin percentage contents are prepared. In this case, "resin percentage content" means a weight ratio of the resin component with respect to an entire weight of the prepreg. The weight of the resin can be obtained by chemically decomposing and removing only the resin component from the resin member or the prepreg corresponding to the measured object so as to pick up only the fiber, and subtracting the total weight of the fiber from the previously measured weight of the resin member. It is possible to chemically remove the resin from the resin material, for example, by using a heated aqua fortis, and it is possible to chemically remove the resin from the prepreg, for example, by using a methyl ethyl ketone. In this example, there is shown an aspect in which the prepreg 11 employs two kinds of prepregs having different resin percentage contents, in particular, a first prepreg 11*a* having a large resin percentage content, and a second prepreg 11*b* having a smaller resin percentage content.

Figure 6:
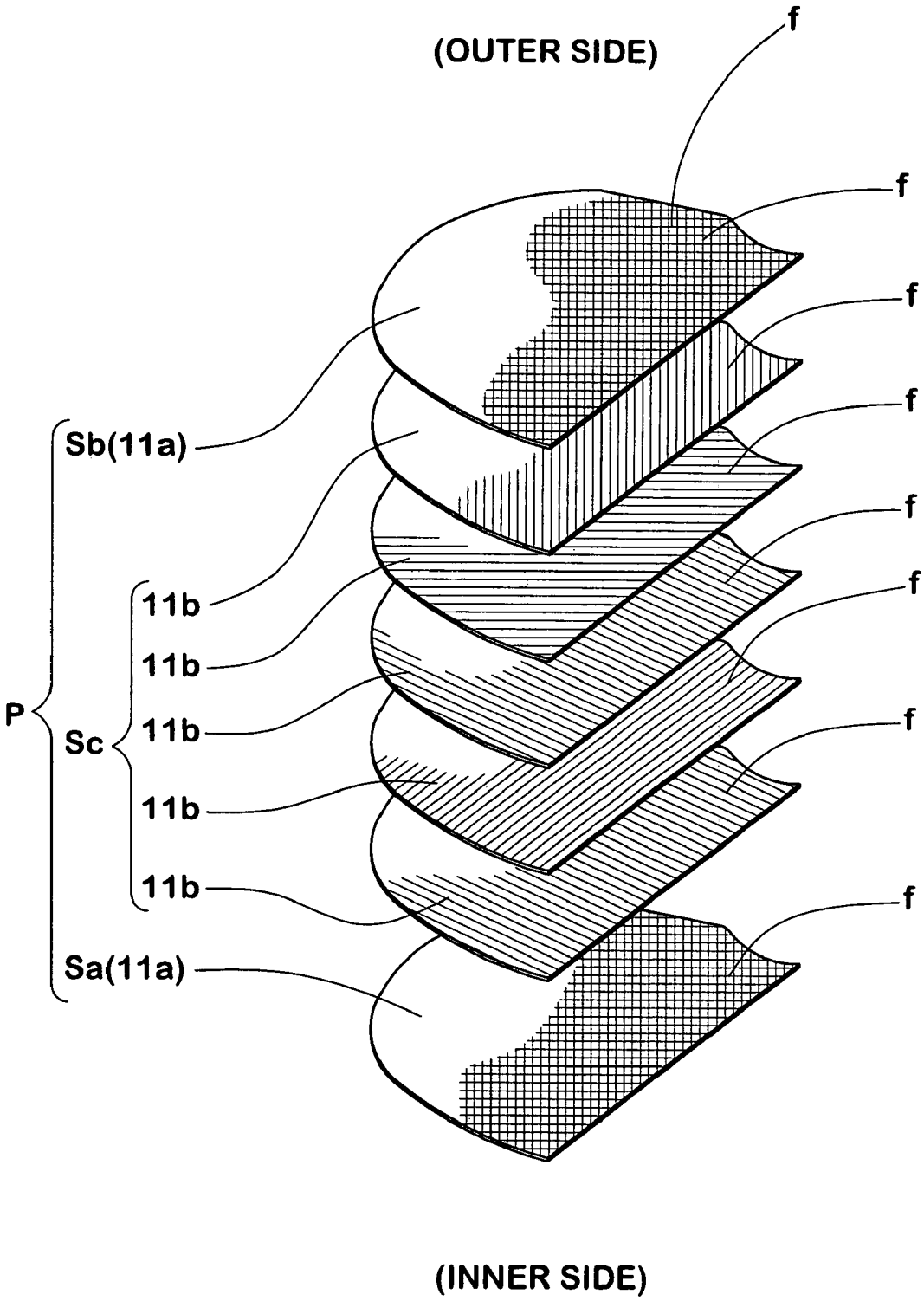
FIG. 6 is an exploded perspective view exemplifying a laminated body of the prepreg.

Further, as shown in FIG. 6, a plurality of prepregs 11 capable of covering the opening portion O1 are prepared as a laminated body P by being laminated. The laminated body P is sectioned into an innermost layer Sa which is closest to the hollow portion i of the head, an outermost layer Sb which is closest to an outer surface of the head, and an intermediate layer Sc which is arranged therebetween and is constituted by a plurality of prepregs in the present embodiment, however, at least the innermost layer Sa employs the first prepreg 11*a* having the largest resin percentage content. In this embodiment, there is shown the example in which the first prepreg 11*a* is used not only in the innermost layer Sa but also in the outermost layer Sb. On the other hand, the intermediate layer Sc employs the second prepreg 11*b* having the smallest resin percentage content. It is desirable that the laminated body P may be, for example, laminated by utilizing a viscosity of the surface of the prepreg 11 itself, or by interposing an uncured resin primer or the like, to prepare in a state in which the laminated body is not easily peeled off, In this case, at a time of composing the laminated body P, as shown in FIG. 5, it is desirable to differentiate an allocating angle θ of the fiber f of the prepreg 11 with respect to a base line BL which is expected as a normal direction of the face surface 2. In accordance with a particularly preferable aspect, it is desirable to employ a so-called cross prepreg woven such that the fibers intersect (intersect at 90° in this example) at least in one of the innermost layer Sa and the outermost layer Sb, more preferably in both thereof. The cross prepreg mentioned above has hardly any irregularities when stretched and serves for reducing the defect in molding. Further, in the present embodiment, the cross prepreg is used such that the allocating angle θ becomes ±45°. With regard to the intermediate layer Sc, there is employed a so-called one-way prepreg (UD prepreg) in which the carbon fibers are aligned in one direction, and the allocating angle θ thereof is set to be substantially 0°, 90°, 0°, 45° and 45° from an inner side. The allocating angle θ can be appropriately set in correspondence to an elastic modulus of the used fiber, a used number and the like. In this case, the "normal direction of the face surface" is regarded as a line segment projecting a normal line drawn from a head gravity point to the face surface to a horizontal surface in the standard condition of the head mentioned above.

Figure 7A:
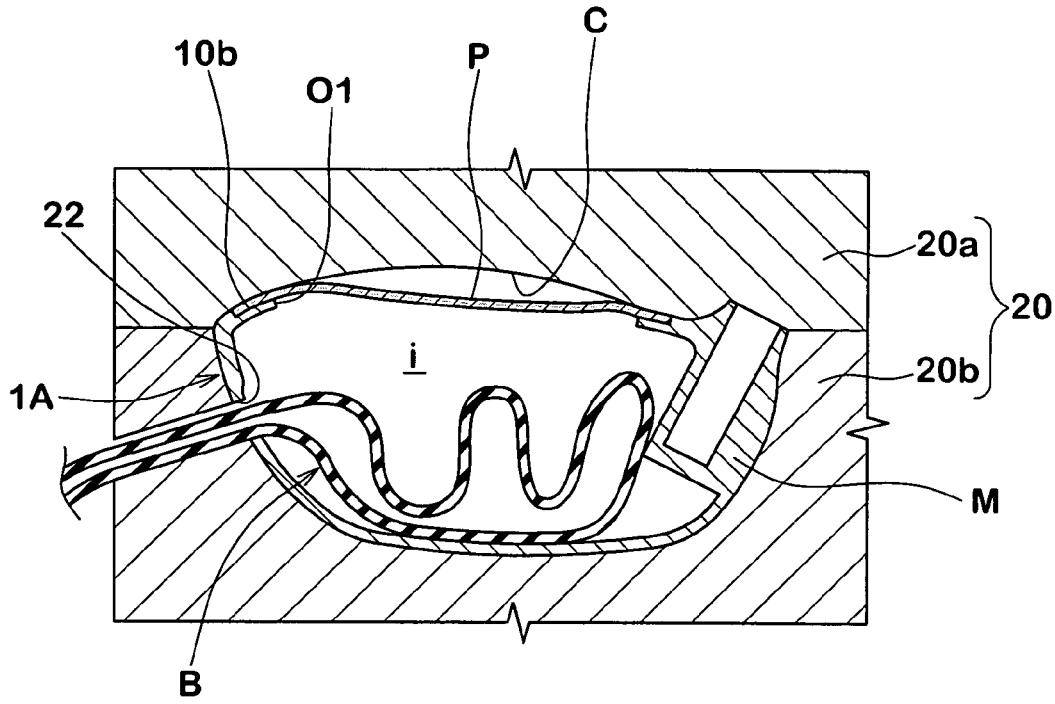
FIGS. 7A and 7B are cross sectional views explaining an internal pressure molding method.

Next, as shown in FIG. 7A, there is executed a preliminary molding step of molding a head base body 1A by attaching the laminated body P to the opening portion O1 of the head shell portion M so as to cover the opening portion O1. The laminated body P is attached to the head shell portion M in a direction in which the first prepreg 11*a* forms the innermost layer Sa as mentioned above. In this embodiment, the peripheral edge portion of the laminated body P is arranged so as to be in contact with the receiving portion 10*b* provided around the opening portion O1. Further, it is possible to prevent both the laminated body P and the receiving portion 10*b* from being displaced by applying, for example, a thermosetting type adhesive agent, a resin primer or the like between the laminated body P of the prepreg and the receiving portion, thereby serving for improving a molding accuracy.

The preliminarily molded head base body 1A is thrown in a metal mold 20, for example, constituted by a pair of detachable upper mold 20*a* and lower mold 20*b*. In this case, the preliminarily molding step can be executed, for example, in a state in which the head shell portion M is previously attached to the lower mold 20*b*. Further, it is desirable that the head shell portion M is provided with a hole 22 communicated with a hollow portion i, for example, in the side portion 6 thereof. A bladder B which can expand and contract on the basis of incomings and outgoings of a pressurized fluid is inserted through the hole 22.

Figure 7B:
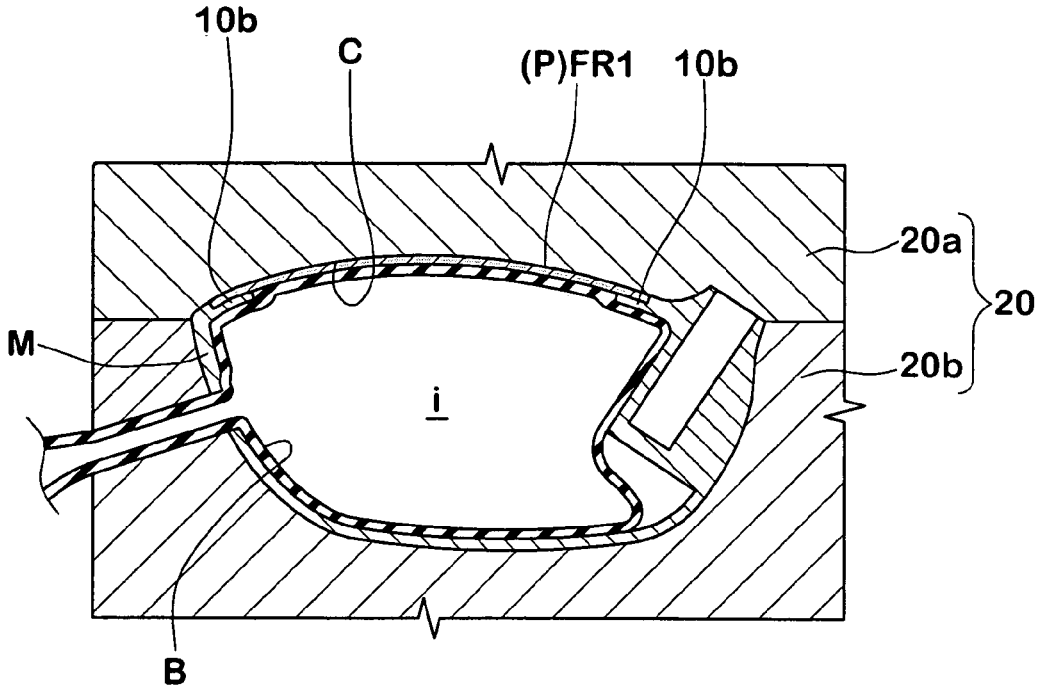

Thereafter, as shown in FIG. 7B, there is executed the internal pressure molding step of expanding and deforming the bladder B in the hollow portion i as well as heating the metal mold 20. Accordingly, the laminated body P of the prepreg sheet which is exposed to the heat and the pressure from the bladder B is deformed and molded along a cavity surface C of the upper mold 20*a* and the desired crown side resin member FR1, and a peripheral edge portion thereof is integrally adhered to the receiving portion 10*b*. At this time, since the prepreg 11*a* having the largest resin percentage content is used in the innermost layer Sa of the laminated body P which is closest to the hollow portion i, it is possible to obtain a smooth resin flow along the surface of the bladder B in the contact surface with the bladder B and the near portion thereof in a plasticized state, that is, an improved flow property can be obtained. In other words, the innermost layer Sa of the laminated body P can flexibly follow the shape of the bladder B, and can uniformly transmit the pressure of the bladder B to the outside prepreg layer. Accordingly, it is possible to apply a uniform pressure to each of the portions of the laminated body P.

Further, in the present embodiment, since the prepreg 11*a* having the larger resin percentage content is also used in the outermost layer Sb of the laminated body P, the improved flow property can be obtained in the contact portion even at a time when the outermost layer Sb is brought into contact with the cavity surface C of the metal mold 20. Accordingly, in the head 1 in accordance with the present embodiment, the laminated body P can receive the uniform pressure from the inner and outer sides, so that it is possible to inhibit the defect in molding such as the crimple or the like from being generated in the resin member.

The defect in molding of the resin member FR is most affected by the resin percentage content of the prepreg 11 structuring the innermost layer Sa which is first contacted with the bladder B in the internal pressure molding step. Accordingly, with regard to the outermost layer Sb of the laminated body P, it is not necessary to use the first prepreg 11*a* having the largest resin percentage content, but the second prepreg 11*b* can be used. However, in order to secure an improved flow property at a time of being in contact between the outermost layer Sb of the laminated body P and the cavity surface of the metal mold 20, it is desirable to preferably use the first prepreg 11*a* having the largest resin percentage content in the innermost layer Sa, or use the third prepreg (not shown) in which the resin percentage content is smaller than the first prepreg 11*a* and larger than the second prepreg 11*b*.

Further, when the laminated body P is heated for a necessary time and the molding is completed, the fluid is discharged from the bladder and the bladder B is contracted, whereby the bladder B is taken out to the external portion of the head shell portion M through the hole 22. The hole 22 can be closed by a budge, a cover or the other member to which a trade name of the head, an ornamental pattern or the like is attached, for example, in the later step.

It is possible to preferably employ the prepreg reinforced by the glass fiber in the innermost layer Sa and/or the outermost layer Sb of the laminated body P, that is, the prepreg having the largest resin percentage content. Since the glass fiber is inexpensive, it is possible to reduce a product cost and the molded product is transparent. Accordingly, in the case that the glass fiber prepreg is used in the innermost layer Sa of the laminated body P, it is possible to see the intermediate layer Sc and confirm the defect in molding of the intermediate layer Sc or the like, for example, by applying light to the hollow portion i from the hole 22. Further, in the case that the glass fiber is used in the outermost layer Sb, it is possible to make the carbon fiber of the intermediate layer Sc see through as the design pattern, and this structure is preferable in view of improving a design property.

An absolute value of the resin percentage content of the first prepreg 11*a* having the largest resin percentage content is not particularly limited, however, if the value is too small, there is a tendency that a flow property of the innermost layer Sa is lowered at a time of the internal pressure molding step, and if the value is inversely too large, an amount of the resin becomes too much, a so-called firmness of the prepreg is lost, and there is a tendency that a usability in the preliminary molding step is deteriorated. From this point of view, it is desirable that the resin percentage content of the first prepreg 11*a* is preferably equal to or more than 45%, more preferably equal to or more than 50%, and further preferably equal to or more than 60%, and an upper limit thereof is preferably equal to or less than 90%, more preferably equal to or less than 80%, and further preferably equal to or less than 70%.

Further, the resin percentage content of the second prepreg 11*b* in which the resin percentage content is smaller than the first prepreg 11*a* is not particularly limited, however, if the value is too small, a sufficient strength as the composite material is hard to be obtained, and if the value is inversely too large, the weight thereof is increased, and an effect of lightening the head weight tends to be lowered. From this point of view, it is desirable that the resin percentage content of the second prepreg 11*a* is preferably equal to or more than 20%, more preferably equal to or more than 30%, and further preferably equal to or more than 35%, and an upper limit thereof is preferably equal to or less than 55%, more preferably equal to or less than 50%, and further preferably equal to or less than 40%.

Further, in the laminated body P, it is desirable that a difference in the resin percentage content between the first prepreg 11*a* having the largest resin percentage content and the second prepreg 11*b* having the smallest resin percentage content is preferably equal to or more than 5%, more preferably equal to or more than 10%, and further preferably equal to or more than 15%, and it is desirable that an upper limit thereof is preferably equal to or less than 50%, more preferably equal to or less than 40%, and further preferably equal to or less than 30%. There is a tendency that if the difference in the resin percentage content is less than 5%, the resin percentage content of the prepreg in the innermost layer Sa becomes excessively small and a flow property is deteriorated, or the resin percentage content of the prepreg in the intermediate layer Sc becomes excessively large and a specific gravity of the resin member becomes large. Further, if the difference in the resin percentage content is more than 50%, a difference in rigidity tends to be generated between the layers, and a point of a stress concentration or the like tends to be generated.

Further, a "metsuke amount" (a weight g of the fiber contained in the prepreg per 1 $m^2$) of the prepreg used in the laminated body P is not particularly limited, however, if it is too small, a thickness of the prepreg becomes small, a handling property is deteriorated and the defect in molding tends to be generated, and if it is inversely too large, the thickness of the prepreg per one sheet becomes large, it is hard to execute an adjustment of the thickness, and a rate of impregnation of the resin becomes uneven, so that a reduction in strength tends to be generated. From this point of view, it is desirable that the "metsuke amount" of the prepreg 11 is preferably equal to or more than 50 $g/m^2$, more preferably equal to or more than 75 $g/m^2$, and further preferably equal to or more than 100 $g/m^2$, and it is desirable that an upper limit thereof is preferably equal to or less than 300 $g/m^2$, more preferably equal to or less than 250 $g/m^2$, and further preferably equal to or less than 200 $g/m^2$.

In the embodiment mentioned above, there is exemplified a case that the laminated body P is constituted by two kinds of prepregs comprising the first and second prepregs 11*a* and 11*b* having the different resin percentage contents. However, for example, the laminated body P may include third and fourth prepregs (not shown) in which the resin percentage content is smaller than the first prepreg 11*a* and larger than the second prepreg 11*b*. In this case, it is desirable that the prescription of the numeric value of the resin percentage content is not only applied between the first and second prepregs 11*a* and 11*b*, but also can be applied between the first prepreg 11*a* and the third prepreg, between third and fourth prepreg, or between fourth and second perperg.

Figure 8:
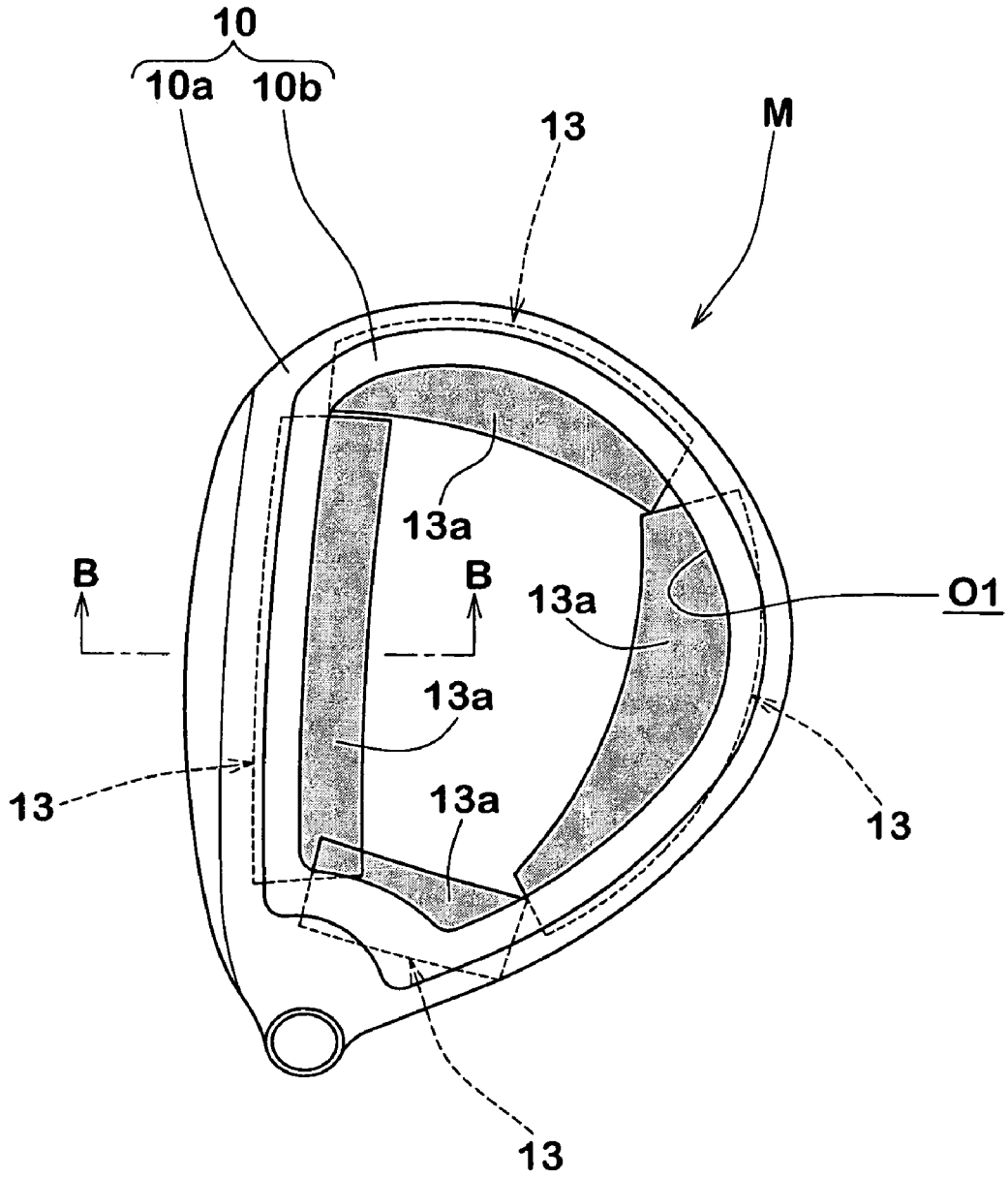
FIG. 8 is a plan view of a head shell portion showing the other embodiment of the internal pressure molding method.
Figure 9A:
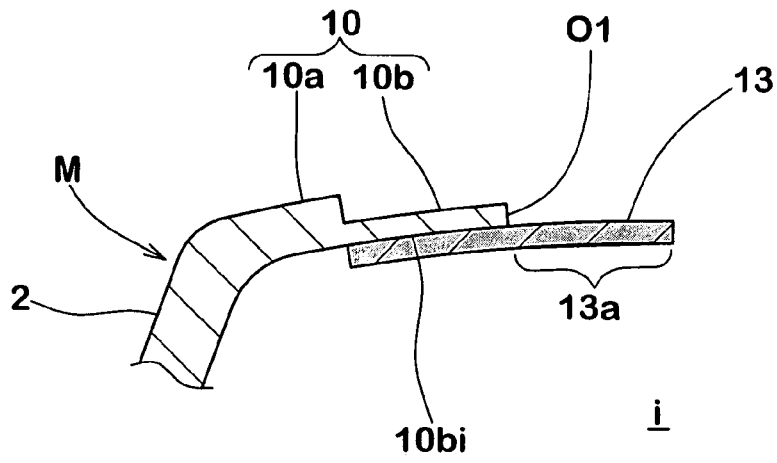
FIGS. 9A to 9C are partially cross sectional views showing the other embodiment of the internal pressure molding method.

Further, in accordance with a preferable aspect, for example, as shown in FIG. 8 and FIG. 9A corresponding to a cross sectional view along a line B-B in FIG. 8, an auxiliary prepreg 13 can be previously attached to an inner surface 10*bi* directed to the hollow portion side of the receiving portion 10*b* of the head shell portion M approximately in the auxiliary molding step, prior to the attachment of the laminated body Pa. The auxiliary prepreg 13 is attached to the inner surface 10*bi* so as to have a protruding portion 13*a* protruding to the opening portion O1 side from the edge of the opening portion O1. The auxiliary prepreg 13 is provided, for example, in at least a part of the periphery of the opening portion O1, however, it is desirable that it is annularly and continuously attached to the periphery of the opening portion O1, preferably as in the present embodiment. The auxiliary prepreg 13 in this example is exemplified as the structure that the auxiliary prepreg is separated into four pieces so as to be continuously arranged around the opening portion O1.

Figure 9B:
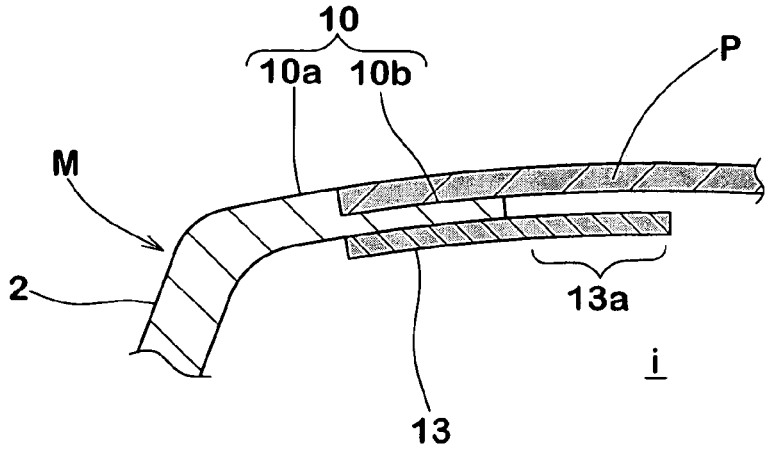
Figure 9C:
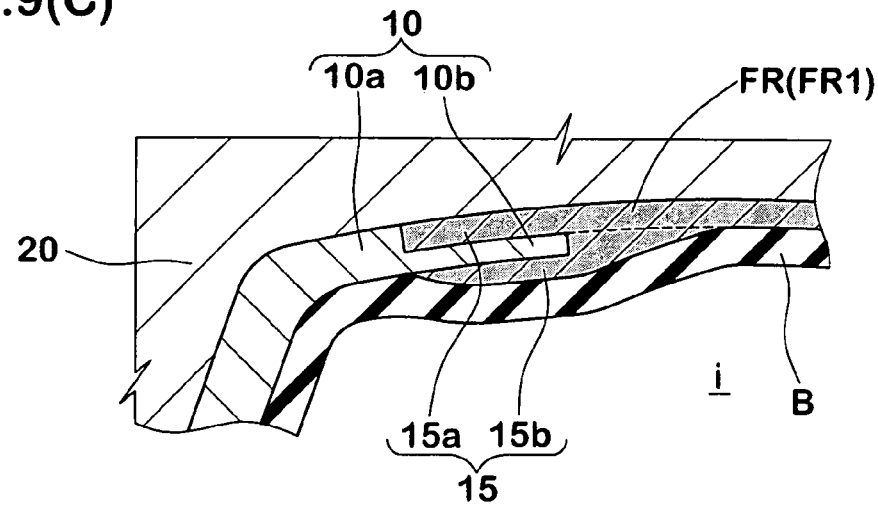

Further, as shown in FIG. 9B, in the same manner as mentioned above, the laminated body P is attached to the receiving portion 10*b* so as to cover the opening portion O1. Further, as shown in FIG. 9C, it is possible to integrally form the laminated body P and the protruding portion 13*a* of the auxiliary prepreg 13, by executing the internal pressure molding step in the metal mold 20. Accordingly, the peripheral edge portion of the resin member FR can be formed as a bifurcated portion 15 having an outer piece portion 15*a* extending along an outer surface side of the receiving portion 10*b* and an inner piece portion 15*b* extending along an inner surface side of the receiving portion 10*b*. As mentioned above, it is possible to increase a bonding area between the resin member FR and the head shell portion M in accordance with a simple procedure and it is possible to manufacture the head 1 having a firm bonding strength, by previously arranging the auxiliary prepreg 13 having the protruding portion 13*a* in the inner surface side of the receiving portion 10*b* and bonding to the innermost layer of the laminated body P with each other, at a time of manufacturing the composite head. In this case, since a used region of the auxiliary prepreg 13 is limited, the auxiliary prepreg 13 is not included in the laminated body P. Accordingly, the resin percentage content thereof is not particularly limited, however, about 30 to 70% is preferable.

Since the head 1 in accordance with the present embodiment can save the weight by using the resin member, it is possible to increase a volume of the head, and it is desirable that the volume of the head is preferably equal to or more than 200 $cm^3$, more preferably equal to or more than 300 $cm^3$, further preferably equal to or more than 380 $cm^3$, and particularly preferably equal to or more than 400 $cm^3$. Therefore, it is possible to increase a sense of security at a time of coming to the ready, and it is possible to increase a sweet spot area and a moment of inertia. Although not particularly limited, it is desirable that the moment of inertia around a perpendicular passing through the head gravity point is preferably equal to or more than 2000 ($g \cdot cm^2$), and more preferably equal to or more than 3000 ($g \cdot cm^2$), and further preferably equal to or more than 3500 ($g \cdot cm^2$), in the standard condition mentioned above. Further, an upper limit of the head volume is not particularly limited, however, it is preferable that the upper limit is restricted to be equal to or less than 470 $cm^3$, in the case of being based on a rule regulation of R&A and USGA.

Figure 10A:
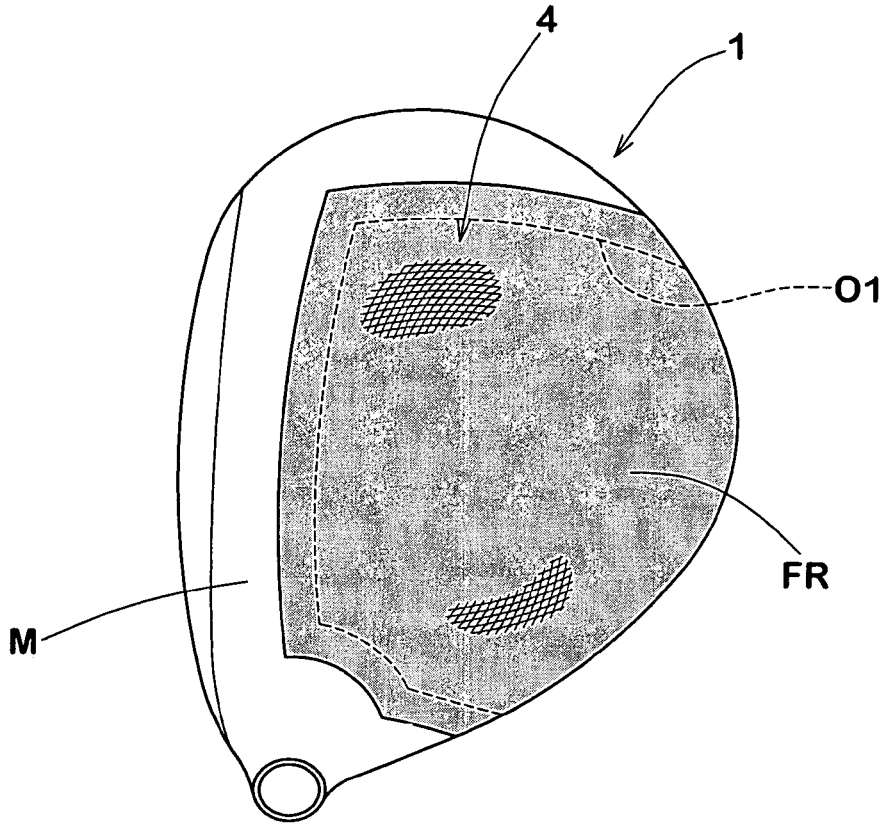
FIGS. 10A and 10B are a plan view of a head and a back elevational view thereof as seen from a back face side, showing the other embodiment in accordance with the present invention.
Figure 10B:
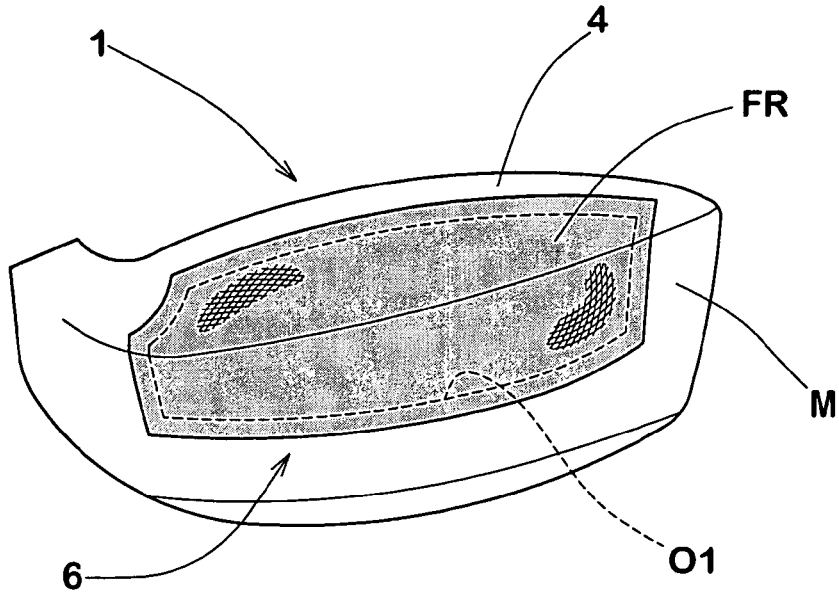

The description is given of the embodiments in accordance with the present invention, however, the present invention is not limited to the embodiments mentioned above, but can be applied to golf club heads of iron type, utility-type, and patter-type. Further, in the embodiment mentioned above, there is shown the aspect that the resin member made of the fiber reinforced resin is constituted by the crown side resin member FR1, however, for example, as shown in FIGS. 10A and 10B, the structure may be made such that a part of the opening portion O1 of the head shell portion M is provided astride the crown portion 4 and the side portion 6 in the back face side, and the resin member FR can be arranged astride the crown portion 4 and the side portion 6. In the embodiment mentioned above, since it is possible to reduce the weight of the head upper portion side in comparison with the aspect shown in FIG. 1, it is possible to set the head gravity point lower.

Figure 11:
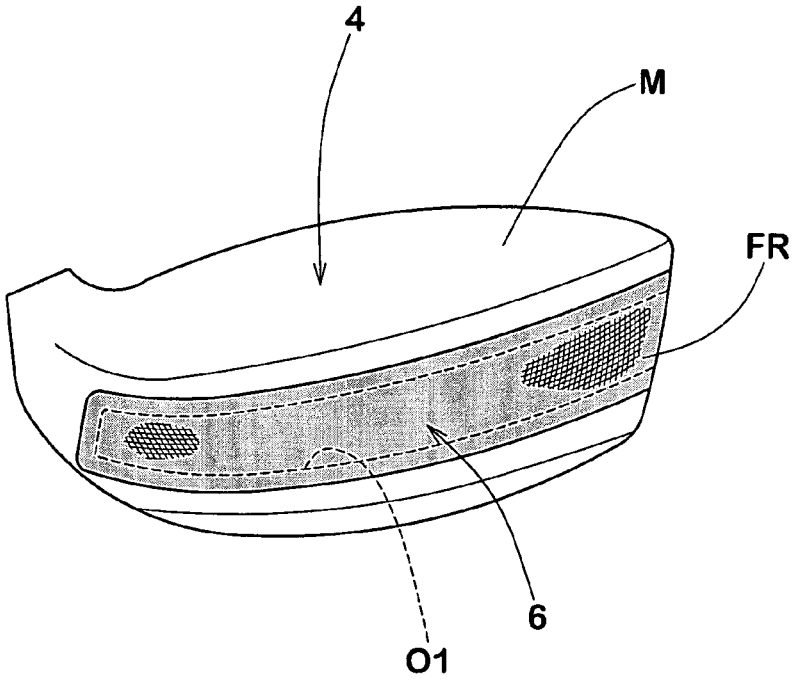
FIG. 11 is a back elevational view as seen from a back face side of the head showing the other embodiment in accordance with the present invention.
Figure 12:
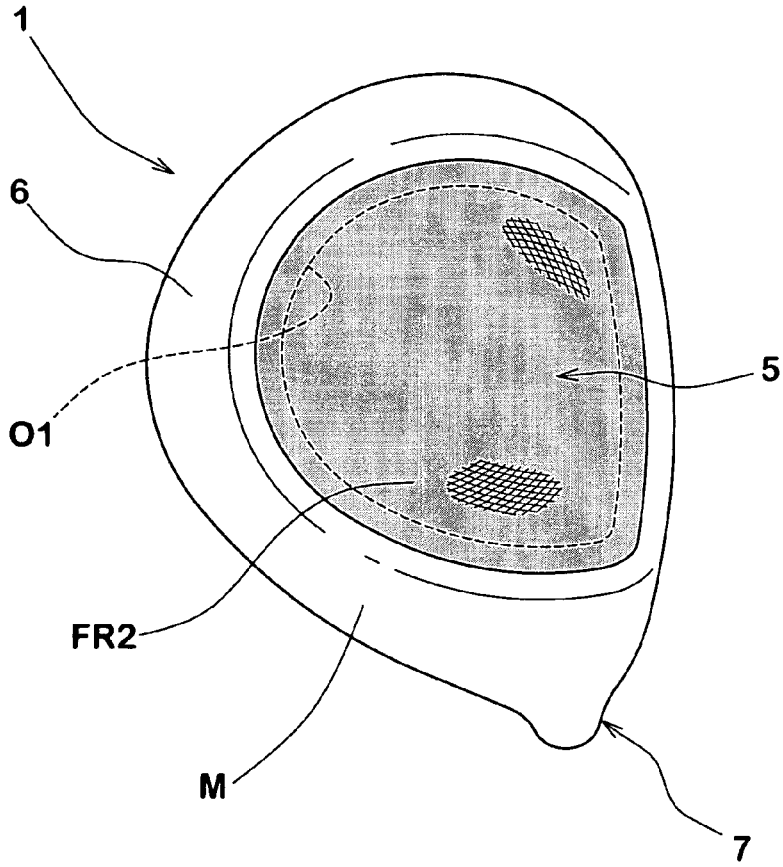
FIG. 12 is a bottom elevational view of the head showing the other embodiment in accordance with the present invention.
Figure 13A:
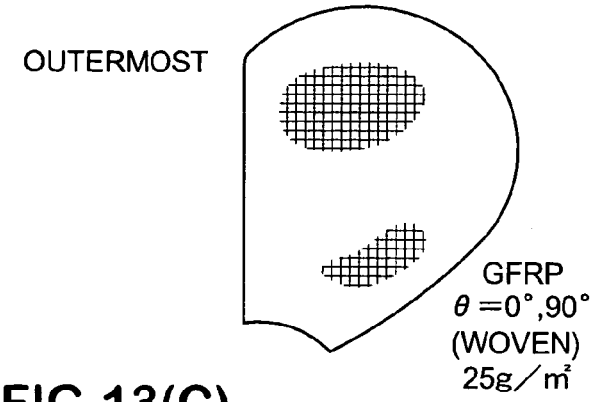
FIG. 13 is an expansion plan view showing the laminated body of the prepreg in accordance with an example and a comparative example in an exploded manner.
Figure 13B:
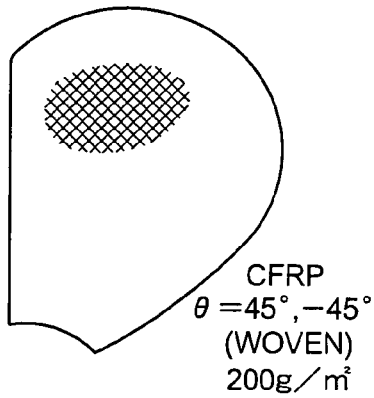
Figure 13C:
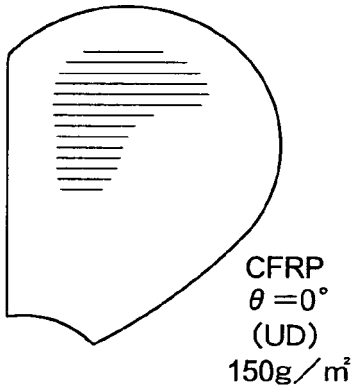
Figure 13D:
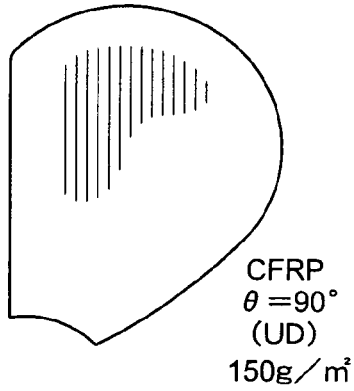
Figure 13E:
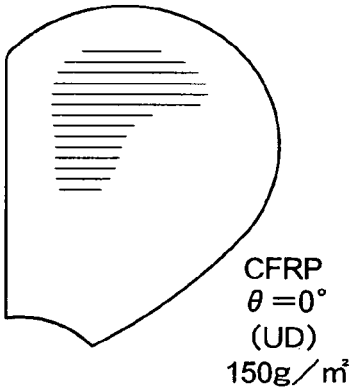
Figure 13F:
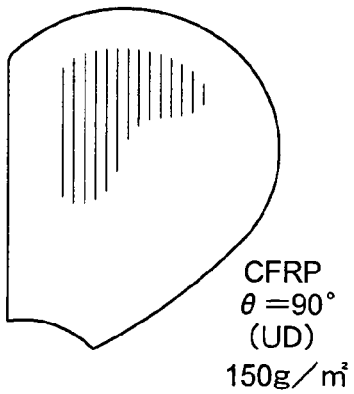
Figure 13G:
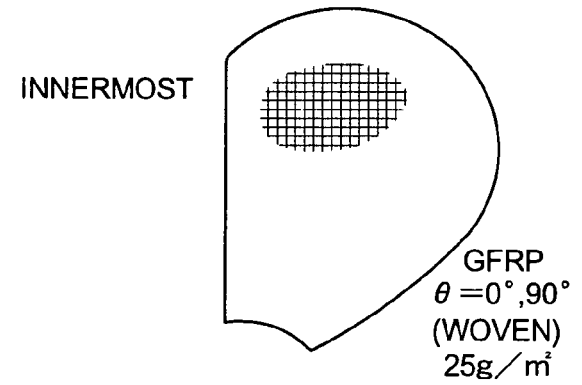

Further, as shown in FIG. 11, the resin member FR can be arranged by forming the opening portion O1 in the side portion 6 of the head shell portion M. In this embodiment, it is possible to increase the moment of inertia around the horizontal axis passing through the head gravity point. Further, as shown in FIG. 12, the sole side resin member FR2 can be provided in addition to the crown side resin member FR1. In this embodiment, it is possible to further increase the moment of inertia around the vertical axis of the head.

EXAMPLES

In order to confirm the effect of the present invention, a wood type driver head having a head volume of 420 $cm^3$ is manufactured by way of trial on the basis of the specification in FIGS. 1 to 3 and Table 1. The ratio S1/S mentioned above between the area S1 of the opening portion and the head area S is set to 0.8. The head shell portion and the resin member are formed in the shape shown in FIGS. 1 to 5. Further, the laminated body of the prepreg employs the prepregs shown by the order of reference symbols (a) to (g) from the outermost layer to the innermost layer, as shown in FIG. 13. A fiber of each of the prepregs, an angle of orientation and a direction of fiber are as illustrated. Further, each of the prepregs (CFRP) using the carbon fiber is constituted by a composite material of a carbon fiber having an elastic modulus in tension of 235 GPa and an epoxy resin. Further, in each of the prepregs, the resin percentage content is differentiated as shown in Table 1.

The head shell portion is integrally cast by using Ti-6Al-4V in order to do away with a dispersion, and thereafter a shape of the opening in the head shell portion is unified by applying an NC work. Further, the protruding portion of 10 mm of the auxiliary prepreg sheet is previously formed in the head shell portion by using the auxiliary prepreg sheet having a width of 20 mm as shown in FIG. 9. The composite head is manufactured through the auxiliary molding step and the internal pressure molding step. And a fraction defective and a durability are tested in each of the heads. In this case, the resin member is finished at a thickness of 0.8 to 1.15 mm after being molded.

The test method is as follows.

<Fraction Defective>

Each of one hundred heads is manufactured, and a rate of occurrence of the visually observable crimple and the defect in molding on the surface concavity and convexity in the resin member is measured. Results are expressed by an index in which a comparative example 1 is set to 100. The smaller the numerical value is, the better the head is.

<Durability>

A 45 inch wood type club is manufactured by attaching a carbon shaft MP-200 manufactured by SRI Sports Co., Ltd. to each of the trial heads. The club is attached to a swing robot (SHOT ROB IV) manufactured by MIYAMAE Co., Ltd., and three thousands of golf balls are struck at a head speed of 51 m/s and at a face center position, whereby the durability test is executed. Further, the head in which no damage such as a crack, a fracture and the like is generated is marked as "o", the head in which the damage is generated is marked as "x", and the hitting number at a time when the head is damaged is recorded. Results of test are shown in Table 1.

TABLE 1

| | | | Example 1 | Example 2 | Example 3 | Example 4 | Example 5 | Comparative Example 1 | Comparative Example 2 | Comparative Example 3 |
|---|---|---|---|---|---|---|---|---|---|---|
| Specification of prepreg laminated body | Resin percentage content [%] | Outermost layer (a) | 60 | 60 | 70 | 40 | (None) | (None) | 40 | 60 |
| | | Intermediate layer 1 (b) | 40 | 40 | 55 | 40 | 35 | 40 | 40 | 40 |
| | | Intermediate layer 2 (c) | 35 | 35 | 55 | 35 | 35 | 35 | 35 | 35 |
| | | Intermediate layer 3 (d) | 35 | 35 | 55 | 35 | 35 | 35 | 35 | 35 |
| | | Intermediate layer 4 (e) | 35 | 35 | 55 | 35 | 35 | 35 | 35 | 35 |
| | | Intermediate layer 5 (f) | 35 | 35 | 55 | 35 | 60 | 35 | 35 | 35 |
| | | Innermost layer (g) | 60 | 40 | 70 | 60 | (None) | (None) | 35 | 35 |
| Thickness of resin member (mm) | | | 0.90 | 0.90 | 1.15 | 0.90 | 0.85 | 0.80 | 0.90 | 0.90 |
| Results of test | Head weight [g] | | 195 | 195 | 200 | 195 | 193 | 193 | 194 | 195 |
| | Fraction defective in molding | Crimple (index) | 7 | 28 | 11 | 14 | 18 | 100 | 97 | 90 |
| | | Surface concavity and convexity (index) | 25 | 25 | 16 | 92 | 98 | 100 | 92 | 25 |
| | Durability | | ○ | ○ | ○ | ○ | ○ | x (830) | x (1020) | X (1860) |

As a result of the test, it is confirmed that the heads in accordance with the present invention lower the defect in molding without deteriorating the durability. In particular, in the embodiment 1 and the embodiment 3 in which the prepreg having the large resin percentage content is used in the innermost layer and the outermost layer of the laminated body of the prepreg, it is possible to confirm a significant effect that the defect in molding is significantly lowered.

What is claimed is:

1. A golf club head including a head shell portion made of a metal material and having an opening portion, and a resin member made of a fiber reinforced resin arranged in the opening portion of said head shell portion, said golf club head having an inner hollow portion in an inner portion thereof, wherein said resin member is constituted by a molded body formed by subjecting a laminated body of plural layers of prepregs having a magnitude covering said opening portion and having different resin percentage contents, to integral molding with said head shell portion in accordance with an internal pressure molding method, and wherein a prepreg having the largest resin percentage content is used in an innermost layer of said laminated body which is closest to said hollow portion.

2. A golf club head as claimed in claim 1, wherein the prepreg having the largest resin percentage content has a resin percentage content of 45 to 90% by weight.

3. A golf club as claimed in claim 1 or 2, wherein said laminated body includes a prepreg having the smallest resin percentage content, and a difference of the resin percentage content between the prepreg having the smallest resin percentage content and the prepreg having the largest resin percentage content is 5 to 50% by weight.

4. A golf club head as claimed in claim 1, wherein the prepreg having the largest resin percentage content is reinforced by a glass fiber.

5. A golf club head including a head shell portion made of a metal material and having an opening portion, and a resin member made of a fiber reinforced resin arranged in an opening portion of said head shell portion, said golf club head having an inner hollow portion, wherein said resin member is constituted by a molded body formed by subjecting a laminated body of plural layers of prepregs having a magnitude covering said opening portion and having different resin percentage contents, to integral molding with said head shell portion in accordance with an internal pressure molding method, wherein said laminated body includes an innermost layer closest to said hollow portion, an outermost layer closest to the club head outer surface and an intermediate layer arranged between the innermost and outermost layers, at least one layer of a prepreg having the smallest resin percentage content is used in said intermediate layer, and a layer of a prepreg having a resin percentage content larger than the prepreg having the smallest resin percentage content is used in each of said innermost layer and the outermost layer.

6. A golf club as claimed in claim 5, wherein said innermost layer, or both said innermost and outermost layers, have a resin percentage content of 45 to 90% by weight.

7. A manufacturing method of a golf club head having a hollow portion inside thereof and including a head shell portion made of a metal material and having an opening portion, and a resin member made of a fiber reinforced resin arranged at the opening portion of said head shell portion, said method comprising:

a preliminary molding step of producing a head base body by arranging, at the opening portion of said head shell portion, a laminated body constituted by a plurality of prepregs having a magnitude covering said opening portion and having different resin percentage contents wherein a prepreg having the largest resin percentage content is used in an innermost layer closest to said hollow portion, to cover said opening portion with said laminated body; and an internal pressure molding step of integrally molding said laminated body with said head shell portion by heating said head base body in a metal mold and expanding a bladder inserted into said hollow portion.

* * * * *